US006248708B1

(12) United States Patent
Merz et al.

(10) Patent No.: US 6,248,708 B1
(45) Date of Patent: Jun. 19, 2001

(54) PASTE-FORM DETERGENT CONTAINING A MIXTURE OF ETHOXYLATED ALCOHOLS

(75) Inventors: Thomas Merz, Hilden; Khalil Shamayeli, Duesseldorf, both of (DE)

(73) Assignee: Henkel-Ecolab GmbH & Co. OHG, Duesseldorf (DE)

( * ) Notice: Subject to any disclaimer, the term of this patent is extended or adjusted under 35 U.S.C. 154(b) by 0 days.

(21) Appl. No.: 09/254,355

(22) PCT Filed: Aug. 28, 1997

(86) PCT No.: PCT/EP97/04690

§ 371 Date: Mar. 5, 1999

§ 102(e) Date: Mar. 5, 1999

(87) PCT Pub. No.: WO98/10049

PCT Pub. Date: Mar. 12, 1998

(30) Foreign Application Priority Data

Sep. 5, 1996 (DE) ..... 196 36 035

(51) Int. Cl.[7] ..... C11D 1/72; C11D 1/825

(52) U.S. Cl. ..... 510/404; 510/276; 510/289; 510/318; 510/334; 510/340; 510/341; 510/356; 510/389; 510/398; 510/421; 510/486; 510/511; 510/531; 510/537

(58) Field of Search ..... 510/276, 289, 510/318, 334, 340, 341, 356, 389, 398, 404, 421, 486, 511, 531, 537

(56) References Cited

U.S. PATENT DOCUMENTS

| | | | | |
|---|---|---|---|---|
| 3,931,033 | | 1/1976 | Lohr et al. | 252/122 |
| 4,144,226 | | 3/1979 | Crutchfield et al. | 528/231 |
| 4,146,495 | | 3/1979 | Crutchfield et al. | 252/89 R |
| 4,305,749 | | 12/1981 | Mildenberger et al. | 71/67 |
| 4,664,839 | | 5/1987 | Rieck | 252/175 |
| 4,820,439 | | 4/1989 | Rieck | 252/135 |
| 4,889,644 | | 12/1989 | Amberg et al. | 252/8.9 |
| 4,929,380 | | 5/1990 | Schulz et al. | 252/121 |
| 5,114,611 | | 5/1992 | Kralingen et al. | 252/186.33 |
| 5,221,488 | | 6/1993 | Amberg et al. | 252/8.9 |
| 5,234,628 | * | 8/1993 | Trabitzsch et al. | 252/540 |
| 5,266,233 | | 11/1993 | Houghton et al. | 252/174.21 |
| 5,328,489 | | 7/1994 | Beaujean et al. | 8/111 |
| 5,356,607 | | 10/1994 | Just | 423/334 |
| 5,364,552 | | 11/1994 | Merz et al. | 252/174.22 |
| 5,391,326 | * | 2/1995 | Smith et al. | 252/559 |
| 5,417,951 | | 5/1995 | Just | 423/334 |
| 5,441,661 | | 8/1995 | Beaujean et al. | 252/95 |
| 5,501,814 | | 3/1996 | Engelskirchen et al. | 252/174.17 |
| 5,580,941 | | 12/1996 | Krause et al. | 527/300 |
| 5,929,014 | | 7/1999 | Beaujean et al. | 510/336 |

FOREIGN PATENT DOCUMENTS

| | | |
|---|---|---|
| 94 58592 | 8/1994 | (AU) . |
| 814 956 | 6/1969 | (CA) . |
| 958 618 | 12/1974 | (CA) . |
| 989 557 | 5/1976 | (CA) . |
| 1 036 455 | 8/1978 | (CA) . |
| 2 146 063 | 10/1995 | (CA) . |
| 16 17 141 | 4/1972 | (DE) . |
| 22 53 063 | 5/1973 | (DE) . |
| 22 00 911 | 10/1973 | (DE) . |
| 24 12 837 | 10/1974 | (DE) . |
| 42 21 381 | 2/1994 | (DE) . |
| 43 00 772 | 7/1994 | (DE) . |
| 43 32 849 | 3/1995 | (DE) . |
| 44 30 418 | 10/1995 | (DE) . |
| 195 29 905 | 2/1997 | (DE) . |
| 195 36 082 | 4/1997 | (DE) . |
| 196 05 688 | 8/1997 | (DE) . |
| 196 05 906 | 8/1997 | (DE) . |
| 196 20 411 | 10/1997 | (DE) . |
| 196 20 267 | 11/1997 | (DE) . |
| 0 022 551 | 1/1981 | (EP) . |
| 0 066 944 | 12/1982 | (EP) . |
| 0 164 514 | 12/1985 | (EP) . |
| 0 185 427 | 6/1986 | (EP) . |
| 0 241 984 | 10/1987 | (EP) . |
| 0 253 151 | 1/1988 | (EP) . |
| 0 295 525 | 12/1988 | (EP) . |
| 0 356 707 | 3/1990 | (EP) . |
| 0 374 472 | 6/1990 | (EP) . |
| 0 392 592 | 10/1990 | (EP) . |
| 0 443 651 | 8/1991 | (EP) . |
| 0 458 397 | 11/1991 | (EP) . |
| 0 544 490 | 6/1993 | (EP) . |
| 0 549 271 | 6/1993 | (EP) . |

(List continued on next page.)

*Primary Examiner*—Yogendra Gupta
*Assistant Examiner*—Charles Boyer
(74) *Attorney, Agent, or Firm*—Wayne C. Jaeschke; Glenn E. J. Murphy

(57) ABSTRACT

A paste-form detergent for use in institutional laundries free from synthetic anionic surfactant of the alkyl benzene-sulfonate type containing 5% to 30% by weight of an ethoxylated alcohol corresponding to formula (I):

$$R^1—(OC_2H_2)_m—OH \quad (I)$$

in which $R^1$ is an alkyl or alkenyl group containing 12 to 14 carbon atoms and m has a value of 1 to 8, 1% to 20% by weight of an ethoxylated alcohol corresponding to formula (II):

$$R^2—(OC_2H_2)_n—OH \quad (II)$$

in which $R^2$ is an alkyl or alkenyl group containing 12 to 22 carbon atoms and n has a value of 3 to 14, with proviso that n is greater than m by at least 1.0, 20% to 80% by weight of alkalizing agent, 1% to 20% by weight of long-chain alcohol or alkyl ether corresponding to formula (III):

$$R^3—O—R^4 \quad (III)$$

in which $R^3$ is an alkyl or alkenyl group containing 8–22 carbon atoms and $R^4$ is hydrogen or an alkyl group containing 1 to 6 carbon atoms, and up to 5% by weight of organic builder of the polymeric polycarboxylate type.

15 Claims, No Drawings

FOREIGN PATENT DOCUMENTS

| | | |
|---|---|---|
| 0 630 964 | 12/1994 | (EP) . |
| 0 693 550 | 1/1996 | (EP) . |
| 0 730 023 | 9/1996 | (EP) . |
| 2 254 635 | 7/1975 | (FR) . |
| WO91/02792 | 3/1991 | (WO) . |
| WO91/08171 | 6/1991 | (WO) . |
| WO92/06166 | 4/1992 | (WO) . |
| WO92/21760 | 12/1992 | (WO) . |
| WO93/05134 | 3/1993 | (WO) . |
| WO93/07276 | 4/1993 | (WO) . |
| WO93/08251 | 4/1993 | (WO) . |
| WO93/18140 | 9/1993 | (WO) . |
| WO93/24623 | 12/1993 | (WO) . |
| WO94/02618 | 2/1994 | (WO) . |
| WO94/23053 | 10/1994 | (WO) . |
| WO94/25579 | 11/1994 | (WO) . |
| WO94/25583 | 11/1994 | (WO) . |
| WO95/02044 | 1/1995 | (WO) . |
| WO95/05477 | 2/1995 | (WO) . |
| WO95/07350 | 3/1995 | (WO) . |
| WO95/09229 | 4/1995 | (WO) . |
| WO95/09263 | 4/1995 | (WO) . |
| WO95/10592 | 4/1995 | (WO) . |
| WO95/10615 | 4/1995 | (WO) . |
| WO95/20039 | 7/1995 | (WO) . |
| WO95/20663 | 8/1995 | (WO) . |
| WO95/23221 | 8/1995 | (WO) . |
| WO95/27049 | 10/1995 | (WO) . |
| WO95/29282 | 11/1995 | (WO) . |
| WO95/30010 | 11/1995 | (WO) . |
| WO95/30011 | 11/1995 | (WO) . |
| WO95/30743 | 11/1995 | (WO) . |
| WO95/34627 | 12/1995 | (WO) . |

* cited by examiner

PASTE-FORM DETERGENT CONTAINING A MIXTURE OF ETHOXYLATED ALCOHOLS

BACKGROUND OF THE INVENTION

1. Field of the Invention

This invention relates to paste-form detergents and to a process for their production.

2. Discussion of Related Art

Detergents used in the home are adapted to meet the requirements arising in that environment. Thus, normally they are powders or are sufficiently liquid to be able to be poured out and dosed without difficulty. Since liquid detergents are also expected to be stable in storage over relatively broad temperature ranges, organic solvents and/or hydrotropes are often added to them although they do not make any contribution to the washing or cleaning result and are undesirable for that reason. One way of overcoming possible dosing problems with detergents that are not sufficiently liquid is proposed in European patent application EP 253 151 A2. This document relates to liquid and, in some cases, highly viscous detergents based on nonionic and anionic surfactants which contain polyethylene glycol as hydrotrope and which do not have to be dosed by the user in liquid form, but instead are packed in portions in bags of a water-soluble material, for example polyvinyl alcohol.

The paste-form detergent described in European patent EP 295 525 B1 consists of a phase formed from nonionic surfactant which is liquid at temperatures below 10° C. and a solid phase with a certain particle size dispersed therein which is formed from washing alkalis, sequestering agents and optionally anionic surfactants. The surfactants or surfactant mixtures used must have a pour point (solidification point) below 5° C. to avoid solidification of the paste at low transportation and storage temperatures. This detergent paste is intended for institutional laundries and is so free-flowing that it can be pumped by a standard feed pump through a suction line. However, it has been found that pastes of the type in question are not always able satisfactorily to guarantee the homogeneity of their ingredients during the production process and, in many cases, also tend to separate in storage. This applies not only to the separation of the solid constituents from the liquid constituents, but also to the phase separation of the liquid ingredients.

International patent application WO 95/09229 describes another paste-form detergent which contains as its nonionic surfactant 40 to 70% by weight of ethoxylated $C_{10-20}$ fatty alcohol liquid at room temperature with an average degree of ethoxylation of 1 to 8 and 20 to 50% by weight of ethoxylated and propoxylated $C_{10-20}$ fatty alcohol liquid at room temperature with an average degree of ethoxylation of 2 to 8 and an average degree of propoxylation of 1 to 6 and 1 to 10% by weight of soap. This paste-form detergent is so pseudo-plastic that it does not flow under the effect of gravity at room temperature, but develops a distinctly lower viscosity on exposure to shear forces and then flows under the effect of gravity. This paste-form detergent is preferably dosed by subjecting it to shear forces to reduce its viscosity and dosing the now flowable detergent by feed pumps.

Recently, the demand to dispense with detergent ingredients which have been found to show inadequate biodegradability has also arisen in institutional laundries. This demand is particularly difficult to meet because the performance of the detergents has to satisfy far more stringent requirements by comparison with the conditions prevailing in domestic washing. This applies in particular to the surface-active ingredients which make a particularly crucial contribution towards the cleaning result and among which synthetic anionic surfactants, particularly of the sulfonated alkyl benzene type, play a leading role in this regard.

Accordingly, the problem addressed by the present invention was to provide a paste-form detergent for use in institutional laundries which would combine high stability in storage with high washing performance in the absence of synthetic anionic surfactants of the alkyl benzenesulfonate type normally required to that end.

This problem has largely been solved by optimizing the nonionic surfactant component and by using long-chain alcohols and/or long-chain alkyl ethers.

DESCRIPTION OF THE INVENTION

The present invention relates to a paste-form detergent for use in institutional laundries containing nonionic surfactant, organic and/or inorganic builder, alkalizing agent and optionally bleaching agent, enzyme, redeposition-inhibiting polymer and other typical ingredients, characterized in that it is free from synthetic anionic surfactant of the alkyl benzenesulfonate type and contains 5% by weight to 30% by weight and, more particularly, 10% by weight to 25% by weight of an ethoxylated alcohol corresponding to general formula (I):

$$R^1—(OC_2H_4)_m—OH \quad (I)$$

in which $R^1$ is an alkyl or alkenyl group containing 8 to 14 carbon atoms and the average degree of ethoxylation m may assume values of 1 to 8, 1% by weight to 20% by weight and, more particularly, 5% by weight to 15% by weight of an ethoxylated alcohol corresponding to general formula (II):

$$R^2—(OC_2H_4)_n—OH \quad (II)$$

in which $R^2$ is an alkyl or alkenyl group containing 12 to 22 carbon atoms and the average degree of ethoxylation n may assume values of 3 to 14, with the proviso that n is greater than m by at least 1.0 and, more particularly, by at least 2.0, 20% by weight to 80% by weight of alkalizing agent, 1% by weight to 20% by weight and, more particularly, 3% by weight to 15% by weight of long-chain alcohol or alkyl ether corresponding to general formula (III):

$$R^3—O—R^4 \quad (III)$$

in which $R^3$ is an alkyl or alkenyl group containing 8 to 22 carbon atoms and $R^4$ is hydrogen or an alkyl group containing 1 to 6 carbon atoms, and up to 5% by weight of organic builder of the polymeric polycarboxylate type. Polymeric polycarboxylates in the context of the invention are understood to be polymerization products of unsaturated mono- and/or dicarboxylic acids which, apart from carboxyl groups, have no other functionalities.

The liquid phase of the paste-form detergent according to the invention is largely formed by the nonionic surfactants corresponding to formulae I and II, which have different carbon chain lengths and different degrees of ethoxylation, and the alcohols or ethers corresponding to formula III. The viscosity of the detergent according to the invention can be adjusted by combining ethoxylated alcohols corresponding to formulae I and II. In the compounds corresponding to formulae I and II, the substituents $R^1$ and $R^2$ may be linear or branched, for example 2-methyl-branched, linear substituents containing primary etherified alcohol functions being preferred. The nonionic surfactant of formula I preferably has a carbon chain length of 8 to 14 and, more particularly, 12 to 14 carbon atoms and an average degree of ethoxylation m of 1 to 8. The nonionic surfactant corresponding to formula II has a broader carbon chain length distribution towards longer chains with 12 to 22 and, more particularly, 12 to 18 carbon atoms and a higher average degree of alkoxylation n of 3 to 14. The ethoxylated alcohols corresponding to formula I and the ethoxylated alcohols corresponding to formula II are preferably present in ratios by weight of 2:1 to 1:1.8. The detergent according to the invention may contain other nonionic surfactants typically used in detergents such as, for example, alkyl polyglycosides and/or fatty acid polyhydroxyamides. However, the surfactant component is preferably free from propoxylated alcohols on account of their relatively poor biodegradability.

With regard to the alcohols or ethers corresponding to general formula III, which contribute towards the particularly high stability of the detergents according to the invention at low temperatures and, in addition, can contribute towards their washing performance, the foregoing observations on the substituents $R^1$ and $R^2$ largely apply to the substituent $R^3$. Besides hydrogen, $R^4$ is preferably a methyl, ethyl, propyl or butyl group, hydrogen and the methyl group being particularly preferred. In a preferred embodiment of the invention, the detergents contain up to 10% by weight and preferably 2% by weight to 6% by weight of compounds corresponding to general formula Ill.

The detergent may contain up to 5% by weight and, more particularly, 0.5% by weight to 3% by weight of natural or synthetic anionic surfactants as further surfactants. Suitable synthetic anionic surfactants, which may advantageously be incorporated in the detergent according to the invention in solid, fine-particle and largely water-free form, include in particular those of the sulfonate or sulfate type which are normally present as alkali metal salts, preferably sodium salts. However, the above-mentioned surfactants of the sulfonate type in particular may also be used in the form of their free acids. Suitable anionic surfactants of the sulfonate type are linear alkane sulfonates containing 11 to 15 carbon atoms which are obtainable by sulfochlorination or sulfoxidation of alkanes and subsequent saponification or neutralization, salts of sulfofatty acids and esters thereof which are derived from saturated $C_{12-18}$ fatty acids sulfonated in particular in the α-position and lower alcohols, such as methanol, ethanol and propanol, and olefin sulfonates which are obtained, for example, by sulfonation of terminal $C_{12-18}$ olefins and subsequent alkaline hydrolysis. Suitable surfactants of the sulfate type are, in particular, primary alkyl sulfates preferably containing linear alkyl chains with 10 to 20 carbon atoms which contain an alkali metal, ammonium or alkyl- or hydroxyalkyl-substituted ammonium ion as counter cation. The derivatives of linear alcohols containing in particular 12 to 18 carbon atoms and branched-chain analogs thereof, so-called oxoalcohols, are particularly suitable. Accordingly, the sulfation products of primary fatty alcohols containing linear dodecyl, tetradecyl or octadecyl radicals and mixtures thereof are particularly useful. Particularly preferred alkyl sulfates contain a tallow alkyl radical, i.e. mixtures essentially containing hexadecyl and octadecyl radicals. The alkyl sulfates may be produced in known manner by reaction of the corresponding alcohol component with a typical sulfating agent, more particularly sulfur trioxide or chlorosulfonic acid, and subsequent neutralization with alkali metal, ammonium or alkyl- or hydroxyalkyl-substituted ammonium bases. In addition, the sulfated alkoxylation products of such alcohols, so-called ether sulfates, may be present in the detergents. Ether sulfates such as these preferably contain 2 to 30 and, more preferably, 4 to 10 ethylene glycol groups per molecule. Synthetic anionic surfactants of the alkyl benzenesulfonate type are totally absent from the detergents according to the invention. In one preferred embodiment of the invention, the detergent is completely free from synthetic anionic surfactants. Naturally occurring anionic surfactants include, in particular, the soaps which may be present in detergents according to the invention in quantities of preferably up to 5% by weight and, more preferably, from 0.5% by weight to 2% by weight. Suitable soaps are, in particular, the alkali metal salts of saturated and/or unsaturated $C_{12-18}$ fatty acids, for example coconut oil, palm kernel oil or tallow fatty acid. It is particularly preferred to use salts of a carboxylic acid mixture of—based on the carboxylic acid mixture as a whole—2% by weight to 8% by weight of $C_{14}$ carboxylic acid, up to 1% by weight of $C_{15}$ carboxylic acid, 18% by weight to 24% by weight of $C_{16}$ carboxylic acid, up to 3% by weight of $C_{17}$ carboxylic acid, 20% by weight to 42% by weight of $C_{18}$ carboxylic acid and 30% by weight to 44% by weight of $C_{20-22}$ carboxylic acid.

The solid phase of the detergent according to the invention is largely formed by the alkalizing agents and builders, although other particulate auxiliaries may optionally be present. The solid phase should be uniformly dispersed in the liquid surfactant phase. The ingredients of the paste-form detergent present as the solid phase should be particulate with an average particle size of 5 μm to 200 μm, at most 10% of the particles being larger than 200 μm in size. Surprisingly, relatively coarse-particle solids, for example those containing 20 to 50% of particles larger than 100 μm in size, may be incorporated in the paste-form detergent without any disadvantage. The average particle size of the particles forming the solid phase is preferably in the range from 10 μm to 80 μm and more preferably in the range from 10 μm to 60 μm, the maximum particle size being below 300 μm and, in particular, below 250 μm. In a preferred embodiment, 90% by weight of the solid powder-form components are smaller than 200 μm in size and, in particular, smaller than 140 μm in size. The average particle size may be determined by known methods (for example by laser diffraction or by the Coulter Counter Method).

The alkalizing agents present as an additional component are often also referred to as washing alkalis. They may be largely assigned to the solid phase. Under the conditions under which the detergents according to the invention are used, they provide for a pH value in the alkaline range which is normally between 9 and 13 and, more particularly, between 10 and 12 (as measured on a 1% by weight solution of the detergent in ion-exchanged water). The preferred alkalizing agent is amorphous alkali metal silicate, more particularly sodium metasilicate with an $Na_2O:SiO_2$ ratio of 1:0.8 to 1:0.3 and preferably 1:1, which is used in water-free form. Besides the alkali metal silicate, water-free alkali metal carbonate and alkali metal hydrogen carbonate are also suitable although—as a result of absorption processes—they do require larger amounts of liquid phase and, for this reason, are less preferred. The percentage content of alkalizing agents in the detergent is from 20% by weight to 80% by weight, preferably from 30% by weight to 70% by weight and more preferably from 40% by weight to 60% by weight. The alkalizing component of the detergent according to the invention may consist solely of silicate. Alkali metal carbonate or alkali metal hydrogen carbonate is present in a quantity of preferably at most up to 20% by weight and, more preferably, below 10% by weight. The paste-form detergents according to the invention may also contain polymeric alkali metal phosphates, such as sodium tripolyphosphate, particularly in cases where the presence of phosphate is ecologically safe in the practical application of detergents according to the invention (for example through a phosphate-eliminating wastewater treatment process). The polymeric alkali metal phosphate content is preferably up to 70% by weight and, more preferably, between 15% by weight and 25% by weight, based on the detergent as a whole, the percentage content of the other solids, for example the alkali metal silicate and/or any alumosilicate present, being reduced accordingly.

Particularly suitable organic builders are monomeric polycarboxylic acids or hydroxycarboxylic acids, such as citric acid or gluconic acid or salts thereof and, in addition, those from the class of aminopolycarboxylic acids and polyphosphonic acids. The aminopolycarboxylic acids include nitrilotri-acetic acid, ethylenediamine tetraacetic acid, diethylenetriamine pentaacetic acid and higher homologs thereof, N,N-bis-(carboxymethyl)-aspartic acid being preferred. Suitable polyphosphonic acids are 1-hydroxyethane-1,1-diphosphonic acid, aminotri (methylenephosphonicacid), ethylenediamine-tetra (methylene phosphonic acid) and higher homologs thereof, for example diethylene tetramine tetra(methylene phosphonic acid). The acids mentioned above are normally used in the form of their alkali metal salts, more particularly their sodium or potassium salts. The builders additionally usable in accordance with the invention include homopolymeric and/or copolymeric carboxylic acids or alkali metal salts thereof, the sodium and potassium salts again being particularly preferred. Carboxylates or polymeric carboxylic acids with a relative molecular weight of at least 350 in the form of their water-soluble salts, more particularly in the form of their sodium and/or potassium salts, such as oxidized polysaccharides according to International patent application WO 93/08251, polyacrylates, polymethacrylates, polymaleates and, in particular, copolymers of acrylic acid with maleic acid or maleic anhydride, preferably those of 50 to 70% acrylic acid and 50 to 10% maleic acid as characterized, for example, in European patent EP 022 551, have proved to be particularly suitable. The relative molecular weight of the homopolymers is generally in the range from 1,000 to 100,000 and that of the copolymers in the range from 2,000 to 200,000 and preferably in the range from 50,000 to 120,000, based on free acid. A particularly preferred acrylic acid/maleic acid copolymer has a relative molecular weight of 50,000 to 100,000. Suitable, but less preferred compounds of this class are copolymers of acrylic acid or methacrylic acid with vinyl ethers, such as vinyl methyl ethers, vinyl esters, ethylene, propylene and styrene, in which the acid makes up at least 50% by weight. Other suitable polymeric carboxylates or carboxylic acids are terpolymers which contain two unsaturated acids and/or salts thereof as monomers and vinyl alcohol and/or a vinyl alcohol derivative or a carbohydrate as the third monomer. The first acidic monomer or its salt is derived from a monoethylenically unsaturated $C_{3-8}$ carboxylic acid and preferably from a $C_{3-4}$ monocarboxylic acid, more particularly (meth)acrylic acid. The second acidic monomer or its salt may be a derivative of a $C_{4-8}$ dicarboxylic acid, preferably maleic acid. In this case, the third monomeric unit is formed by vinyl alcohol and/or preferably an esterified vinyl alcohol. Vinyl alcohol derivatives in the form of an ester of short-chain carboxylic acids, for example $C_{1-4}$ carboxylic acids, with vinyl alcohol are particularly preferred. Preferred terpolymers contain 60 to 95% by weight and, more particularly, 70 to 90% by weight of (meth)acrylic acid or (meth)acrylate, preferably acrylic acid or acrylate, and maleic acid or maleate and 5 to 40% by weight and preferably 10 to 30% by weight of vinyl alcohol and/or vinyl acetate. Terpolymers in which the ratio by weight of (meth) acrylic acid to maleic acid or maleate is between 1:1 and 4:1, preferably between 2:1 and 3:1 and more preferably between 2:1 and 2.5:1 are most particularly preferred. Both the quantities shown and the ratios by weight apply to the acids. The second acidic monomer or its salt may also be a derivative of an allyl sulfonic acid substituted in the 2-position by an alkyl group, preferably a $C_{1-4}$ alkyl group, or by an aromatic radical derived from benzene or benzene derivatives. Preferred terpolymers contain 40 to 60% by weight and, more particularly, 45 to 55% by weight of (meth)acrylic acid or (meth)acrylate, preferably acrylic acid or acrylate, 10% by weight to 30% by weight and preferably 15% by weight to 25% by weight of methallyl sulfonic acid or methallyl sulfonate and, as the third monomer, 15% by weight to 40% by weight and preferably 20% by weight to 40% by weight of a carbohydrate. This carbohydrate may be, for example, a monosaccharide, disaccharide, oligosaccharide or polysaccharide, mono-, di- or oligosaccharides being preferred. Sucrose is particularly preferred. The use of the third monomer introduces predetermined weak spots into the polymer which are probably responsible for its ready biodegradability. Polymers which are either completely or at least partly neutralized, in particular more than 50% neutralized, based on the carboxyl groups present, are also preferably used. Particularly preferred polymeric polycarboxylates are produced by the processes described in German patent application DE 43 00 772 and German patent DE 42 21 381. The polyacetal carboxylic acids which are described, for example, in U.S. Pat. Nos. 4,144,226 and 4,146,495 and which are obtained by polymerization of esters of glycolic acid, introduction of stable terminal groups and saponification to the sodium or potassium salts may also be used. Polymeric acids obtained by polymerization of acrolein and Canizzaro disproportionation of the polymer with strong alkalis are also suitable. They are essentially made up of acrylic acid units and vinyl alcohol units or acrolein units.

If substances such as these are present in the paste-form detergents according to the invention, the percentage content of organic carboxyfunctional builders in the paste-form detergent according to the invention may be up to 10% by weight and is preferably from 1% by weight to 7.5% by weight and more preferably from 2% by weight to less than 5% by weight, the percentage content of polymeric polycarboxylate being as small as possible and less than 5% by weight These substances are also used in water-free form.

Besides the phosphate mentioned at above, inorganic builders suitable for use in detergents according to the invention are crystalline alkali metal silicates and fine-particle alkali metal alumosilicates, more particularly zeolites of the NaA, X and/or P type. Suitable zeolites normally have a calcium binding capacity of 100 to 200 mg CaO/g, as measured in accordance with German patent DE 24 12 837. Their particle size is normally in the range from 1 $\mu$m to 10 $\mu$m. They may be used in dry form. The water present in combined form in the zeolites is not problematical in the present case. Preferred crystalline silicates, which may be present either on their own or in the form of a mixture with the alumosilicates mentioned, are crystalline layer silicates with the formula $NaMSi_xO_{2+x}\cdot yH_2O$, in which M is hydrogen or sodium, x is a number of 1.9 to 4 and y is a number of 0 to 20. Preferred values for x are 2, 3 and 4. Crystalline layer silicates such as these are described, for example, in European patent application EP 164 514. Both β- and δ-sodium disilicates $NaSi_2O_5 \cdot yH_2O$ are particularly preferred, β-sodium disilicate being obtainable, for example, by the process described in International patent application WO 91/08171. Useful crystalline silicates are marketed under the names of SKS6 (Hoechst) and Nabion® 15 (Rhone-Poulenc). The content of inorganic builder in the paste may be up to 35% by weight and is preferably up to 25% by weight and, more preferably, between 10% by weight and 25% by weight.

In one preferred embodiment, the detergents according to the invention contain from 5% by weight to 25% by weight and, more particularly, from 10% by weight to 20% by weight of builders, the quantity of polymeric polycarboxylates being no more than 5% by weight and, more particularly, 0% by weight and the quantity of phosphonates being no more than 0.5% by weight and, in particular, no more than 0.2% by weight.

In addition, a paste-form detergent according to the invention may contain oxygen-containing oxidizing agent and, optionally, bleach activator. The oxidizing agent is selected in particular from inorganic peroxygen compounds, particular significance being attributed to sodium perborate tetrahydrate and to sodium perborate monohydrate besides sodium percarbonate. Other suitable oxidizing agents are, for example, persulfates, peroxypyrophosphates, citrate perhydrates and $H_2O_2$-yielding peracidic salts or peracids, such as perbenzoates, peroxophthalates, diperoxyazelaic acid or diperoxydodecanedioic acid. Sodium percarbonate, sodium persulfate and/or sodium perborate monohydrate are preferably used. Oxidizing agents may be present in detergents according to the invention in quantities of preferably up to 25% by weight and, more preferably, from 10% by weight to 20% by weight.

The oxidizing capacity of such oxidizing agents can be improved by the use of bleach activators which form peroxocarboxylic acids under perhydrolysis conditions. The literature contains numerous proposals for such bleach activators, above all from the classes of N- or O-acyl compounds, for example polyacylated alkylenediamines, more especially tetraacetyl ethylenediamine, acylated glycol urils, more especially tetraacetyl glycol uril, N-acylated hydantoins, hydrazides, triazoles, hydrotriazines, urazoles, diketopiperazines, sulfuryl amides and cyanurates, also carboxylic anhydrides, more especially phthalic anhydride, carboxylic acid esters, more especially sodium nonanoyloxybenzenesulfonate, sodium isononanoyloxybenzenesulfonate and triacetin (glycerol triacetate), and acylated sugar derivatives, such as pentaacetyl glucose. A bleach activator which forms peracetic acid under the washing conditions is preferably used, tetraacetyl ethylenediamine being particularly preferred. Detergents according to the invention contain preferably up to 10% by weight and, more preferably, from 3% by weight to 8% by weight of bleach activator. By adding bleach activators, the bleaching effect of water-containing peroxide liquors can be improved to such an extent that substantially the same effects occur at temperatures as low as 60° C. as are obtained with the peroxide liquor alone at 95° C. An improvement in the bleaching effect can be obtained at even lower temperatures by using transition metal salts and complexes, as proposed for example in European patent applications EP 0 392 592, EP 0 443 651, EP 0 458 397, EP 0 544 490, EP 0 549 271, EP 0 630 964 or EP 0 693 550, as so-called bleach catalysts in addition to or instead of the conventional bleach activators. The transition metal complexes known as bleach-activating catalysts from German patent applications DE 195 29 905, DE 195 36 082, DE 196 05 688, DE 196 20 411 and DE 196 20 267 are also particularly suitable. Bleach-activating transition metal complexes, more particularly with the central atoms Mn, Fe, Co, Cu, Mo, V, Ti and/or Ru, are present in detergents according to the invention in quantities of preferably not more than 1% by weight and, more preferably, from 0.0025% by weight to 0.25% by weight.

In addition, a detergent according to the invention may contain other washing aids which may normally be present in quantities of up to about 15% by weight, based on the final detergent. Examples of such washing aids are, for example, enzymes, redeposition inhibitors, soil release agents, optical brighteners, foam regulators and/or dyes and fragrances. Where fragrances—which are generally liquid—are present, they blend with the liquid phase of detergents according to the invention. In view of their small quantity, however, they have no significant effect on the flow behavior of the pastes.

The paste-form detergents according to the invention are substantially free from water and organic solvents. The expression "substantially free from water" describes a state in which the content of free water, i.e. water which is not present in the form of water of hydration or water of constitution, is below 3% by weight, preferably below 2% by weight and more preferably below 1% by weight. Larger water contents are a disadvantage because they disproportionately increase the viscosity of the detergent and, in particular, reduce its stability. Organic solvents, including the low molecular weight and low-boiling alcohols and ether alcohols normally used in liquid concentrates, and hydrotropic compounds are also not present apart from traces which can be introduced through individual active substances.

Enzymes which may optionally be present in the detergents according to the invention include in particular those from the class of proteases, lipases, cutinases, amylases, pullulanases, xylanases, hemicellulases, cellulases, peroxidases and oxidases or mixtures thereof, the use of protease, amylase, lipase and/or cellulase being particularly preferred. The percentage enzyme content is preferably from 0.2% by weight to 1.5% by weight and more preferably from 0.5% by weight to 1% by weight. The enzymes may be adsorbed onto supports and/or encapsulated in shell-forming substances in the usual way or may be incorporated in the pastes as concentrated, substantially water-free liquid formulations. Useful proteases are known, for example, from International patent applications WO 91/02792, WO 92/21760, WO 93/05134, WO 93/07276, WO 93/18140, WO 93/24623, WO 94/02618, WO 94/23053, WO 94/25579, WO 94/25583, WO 95/02044, WO 95/05477, WO 95/07350, WO 95/10592, WO 95/10615, WO 95/20039, WO 95/20663, WO 95/23221, WO 95/27049, WO 95/30010, WO 95/30011, WO 95/30743 and WO 95/34627. Enzymes stabilized against oxidation damage, for example the proteases and amylases known under the commercial names of Durazym® or Purafect® OxP and Duramyl® or Purafect® OxAm, are preferably used.

Suitable redeposition inhibitors or soil-release agents are cellulose ethers, such as carboxymethyl cellulose, methyl cellulose, hydroxyalkyl celluloses and cellulose mixed ethers, such as methyl hydroxyethyl cellulose, methyl hydroxypropyl cellulose and methyl carboxymethyl cellulose. Sodium carboxymethyl cellulose and mixtures thereof with methyl cellulose are preferably used. The soil release agents normally used include copolyesters containing dicarboxylic acid units, alkylene glycol units and polyalkylene glycol units. Soil release copolyesters of the type mentioned and their use in detergents have long been known. For example, DE-A 16 17 141 describes a washing process using polyethylene terephthalate/polyoxy-ethylene glycol copolymers. DE-A 22 00 911 describes detergents containing nonionic surfactant and a copolymer of polyoxyethylene glycol and polyethylene terephthalate. DE-A 22 53 063 describes acidic textile finishes containing a copolymer of a dibasic carboxylic acid and an alkylene or cycloalkylene polyglycol and, optionally, an alkylene or cycloalkylene glycol. European patent EP 066 944 relates to textile treatment formulations containing a copolyester of ethylene glycol, polyethylene glycol, aromatic dicarboxylic acid and sulfonated aromatic dicarboxylic acid in certain molar ratios. Methyl- or ethyl-terminated polyesters containing ethylene and/or propylene terephthalate units and polyethylene oxide terephthalate units and detergents containing a soil release polymer such as this are known from European patent EP 185 427. European patent EP 241 984 relates to a polyester which, in addition to oxyethylene groups and terephthalic acid units, also contains substituted ethylene units and glycerol units. The percentage content of redeposition inhibitors and/or soil release agents in detergents according to the invention is generally not more than 2% by weight and preferably between 0.5% by weight and 1.5% by weight. In one preferred embodiment of the invention, the detergent is free from such active substances.

The detergents according to the invention may contain, for example, derivatives of diaminostilbene disulfonic acid or alkali metal salts thereof as optical brighteners, more particularly for textiles of cellulose fibers (for example cotton). Suitable optical brighteners are, for example, salts of 4,4'-bis-(2-anilino-4-morpholino-1,3,5-triazin-6-ylamino)-stilbene-2,2'-disulfonic acid or compounds or similar structure which contain a diethanolamino group, a methylamino group or a 2-methoxyethylamino group instead of the morphlino group. Brighteners of the substituted 4,4'-distyryl diphenyl type, for example 4,4'-bis-(4-chloro-3sulfostyryl)-diphenyl, may also be present. Mixtures of brighteners may also be used. Brighteners of the 1,3-diaryl-2-pyrazoline type, for example 1-(p-sulfamoylphenyl)-3-(p-chlorophenyl)-2-pyrazoline, and compounds of similar structure are particularly suitable for polyamide fibers. The content of optical brighteners or mixtures thereof in the detergent according to the invention is generally not more than 1% by weight and is preferably from 0.05% by weight to 0.5% by weight. In one preferred embodiment of the invention, the detergent is free from such active substances.

The typical foam regulators suitable for use in the detergents according to the invention include, for example, polysiloxane/silica mixtures, the fine-particle silica present therein preferably being silanized. The polysiloxanes may consist both of linear compounds and of crosslinked polysiloxane resins and mixtures thereof. Other defoamers are paraffin hydrocarbons, more particularly microparaffins and paraffin waxes with melting points above 40° C., saturated fatty acids and soaps containing in particular 20 to 22 carbon atoms, for example sodium behenate, and alkali metal salts of phosphoric acid monoalkyl and/or dialkyl esters in which the alkyl chains contain 12 to 22 carbon atoms. Sodium monoalkyl phosphate and/or dialkyl phosphate containing $C_{16-18}$ alkyl groups is particularly preferred. The percentage content of foam regulators is preferably from 0.2% by weight to 2% by weight. In many cases, the tendency to foam can be reduced by suitably selecting the nonionic surfactants, so that - in a preferred embodiment of the invention—there is no need whatever to use defoaming agents.

In order to increase the physical stability and the chemical stability, more particularly of the bleaching component and enzymes optionally present, the detergents may also contain dehydrating agents, for example in the form of salts which bind water of crystallization, such as anhydrous sodium acetate, calcium sulfate, calcium chloride, sodium hydroxide, magnesium silicate, or metal oxides, such as CaO, MgO, $P_4O_{10}$ or $Al_2O_3$. Dehydrating agents such as these, with which the water content of the detergents according to the invention can be reduced to particularly low values, are present in the detergents according to the invention in quantities of preferably 1% by weight to 10% by weight and, more preferably, 2% by weight to 8% by weight.

In the production of the paste-form detergent according to the invention, the surfactant components, i.e. the nonionic surfactants corresponding to formulae I and II and the alcohols or ethers corresponding to formula III and optionally soap and synthetic anionic surfactants, are preferably mixed to form a uniform compound in which the solids and other components, if any, are then incorporated. If the particulate solids are not sufficiently fine, one or more grinding steps may be included.

A paste-form detergent according to the invention has a viscosity at 25° C. of, preferably, 80,000 mPa•s to 250,000 mPa•s and, more preferably, 100,000 mPa•s to 250,000 mPa•s, as measured with a Brookfield rotational viscosimeter (spindle No. 7) at 5 revolutions per minute. Under otherwise the same conditions, the viscosity at 50 revolutions per minute is preferably in the range from 20,000 mPa•s to 80,000 mPa•s. In one particular embodiment of the invention, the paste-form detergent preferably has such a viscosity at room temperature that it does not flow under the effect of gravity. Preferably, it is then particularly pseudoplastic, i.e. it has a distinctly lower viscosity on shearing and flows under the effect of gravity. In a particularly preferred embodiment, it has a viscosity of 8,000 mPa•s to 45,000 mPa•s at 25° C. and at a shear rate of 0.01 $s^{-1}$, as determined with a Bohlin CVO CS rheometer with a plate/plate measuring system (plate interval 1 to 3 mm). On exposure to adequate shear forces, a detergent according to the invention preferably has a considerably lower viscosity, generally 100 to 2,000 times lower, more particularly in the range from 40 mPa•s to 60 mPa•s at a shear rate of 10 $s^{-1}$ for otherwise the same measuring conditions. The viscosity values shown are read off after a measuring time of 3 minutes in order to allow for possible thixotropic effects of the paste. The reduction in viscosity on shearing is largely reversible, i.e. on removal of the shear forces, the detergent returns to its original physical state without separating. It is pointed out in this connection that the viscosity values mentioned are not measured immediately after production of the paste, but after storage when the paste is so to speak in equilibrium because the shear forces active during the production process lead to a relatively low paste viscosity which only increases gradually to the critical final value. Storage times of one month are generally entirely sufficient for this purpose.

A detergent according to the invention normally has a density of 1.3 kg/l to 1.6 kg/l. The detergent according to the invention can be dosed using conventional paste dispensers, for example of the type described in International patent application WO 95/29282, German patent application DE 196 05 906, German patent DE 44 30 418 or European patents EP 0 295 525 and EP 0 356 707. A dispenser particularly suitable for dosing pseudoplastic paste-form detergents is known, for example, from International patent application WO 95/09263 and is preferably used for dispensing pseudoplastic pastes according to the invention. The detergent according to the invention may optionally be packed in portions in films, particularly water-soluble films. Films such as these are described, for example, in European patent application EP 253 151.

EXAMPLES

Some examples of the composition of detergents according to the invention are given in the following Table. The paste-form detergents had very high stability in storage and, despite the absence of synthetic anionic surfactants, had an excellent cleaning effect.

TABLE 1

Composition or paste-form detergents (% by weight)

| Component | 1 | 2 | 3 | 4 | 5 | 6 |
|---|---|---|---|---|---|---|
| Nonionic surfactant I[a)] | 19 | 19 | 18 | 18 | 18 | 11 |
| Nonionic surfactant II[b)] | 11 | 11 | 11 | 11 | 11 | 18 |
| Isotridecanol | — | — | 5 | 5 | 5 | 5 |
| Soap[c)] | 1 | 1 | 1 | 1 | 1 | 1 |
| Builder I[d)] | 5 | 5 | 5 | 5 | 5 | 5 |
| Builder II[e)] | 0.2 | 0.2 | 0.2 | 0.2 | 0.2 | 0.2 |
| Sodium silicate | 60 | 40 | 47 | 57 | — | — |
| Sodium tripolyphosphate | — | 20 | 20 | — | 20 | 20 |
| Sodium percarbonate | — | — | — | — | 20 | 20 |
| TAED | — | — | — | — | 4 | 4 |
| Enzyme | — | — | — | — | 1 | 1 |
| CMC/MC[f)] | 1 | 1 | 1 | 1 | 1 | 1 |
| Foam inhibitor[g)] | 1 | 1 | 1 | 1 | 1 | 1 |
| Sodium carbonate | | | to 100 | | | |

[a)] $C_{12-14}$ fatty alcohol + 3 EO (Dehydol ® LS 3; manufacturer Henkel KGaA)
[b)] $C_{12-18}$ fatty alcohol + 5 EO (Dehydol ® LT 5; manufacturer Henkel KGaA)
[c)] $C_{16/22}$ fatty acid Na salt (Edenor ® HT 35; manufacturer Henkel KGaA)
[d)] Polymeric polycarboxylate (Sokalan ® CP 5; manufacturer BASF AG)
[e)] Phosphonate (Turpinol ® 2 NZ; manufacturer Henkel KGaA)
[f)] Carboxymethyl cellulose/methyl cellulose mixture (2.5:1)
[g)] Mono-/distearyl phosphate

What is claimed is:

1. A paste-form detergent composition for use in institutional laundries having a liquid and a solid phase and containing nonionic surfactant, organic or inorganic builder, alkalizing agent and optionally bleaching agent, enzyme, redeposition-inhibiting polymer or other typical detergent ingredients, said composition being free from synthetic anionic surfactant of the alkyl benzenesulfonate type and comprising 5% by weight to 30% by weight of an ethoxylated alcohol corresponding to formula (I):

$$R^1—(OC_2H_4)_m—OH \quad (I)$$

wherein $R^1$ is an alkyl or alkenyl group containing 12 to 14 carbon atoms and the average degree of ethoxylation m has a value of 1 to 8, 1% by weight to 20% by weight of an ethoxylated alcohol corresponding to formula (II):

$$R^2—(OC_2H_4)_n—OH \quad (II)$$

wherein $R^2$ is an alkyl or alkenyl group containing 12 to 22 carbon atoms and the average degree of ethoxylation n has a value of 3 to 14, with the proviso that n is greater than m by at least 1.0, 20% by weight to 80% by weight of alkalizing agent, 1% by weight to 20% by weight of a long-chain alcohol or alkyl ether corresponding to formula (III):

$$R^3—O—R^4 \quad (III)$$

in which $R^3$ is an alkyl or alkenyl group containing 8 to 22 carbon atoms and $R^4$ is hydrogen or an alkyl group containing 1 to 6 carbon atoms, and up to 5% by weight of organic builder of the polymeric polycarboxylate type, based on the weight of said composition.

2. A detergent composition as in claim 1 containing 10% by weight to 25% by weight of said ethoxylated alcohol corresponding to formula I.

3. A detergent composition as in claim 1 containing 5% by weight to 15% by weight of said ethoxylated alcohol corresponding to formula II.

4. A detergent composition as in claim 1, wherein the average degree of ethoxylation n of said ethoxylated alcohol corresponding to formula II is higher by at least 2.0 than the average degree of ethoxylation m of the ethoxylated alcohol corresponding to formula I.

5. A detergent composition as in claim 1 containing 3% by weight to 15% by weight of said long-chain alcohol or alkyl ether corresponding to formula III.

6. A detergent composition as in claim 1 containing up to 5% by weight of soap.

7. A detergent composition as in claim 1 containing up to 5% by weight of synthetic anionic surfactant selected from the group consisting of alkyl and alkenyl sulfates and ether sulfates.

8. A detergent composition as in claim 1 containing 30% by weight to 70% by weight of said alkalizing agent.

9. A detergent composition as in claim 1 containing 5% by weight to 25% by weight of builders.

10. A detergent composition as in claim 1 wherein the solid phase comprises fine particles having an average particle size of 5 $\mu$m to 200 $\mu$m.

11. A detergent composition as in claim 10 wherein at most 10% of the particles have a size of more than 200 mm.

12. A detergent composition as in claim 1 containing 0.2% by weight to 1.5% by weight of enzyme.

13. A detergent composition as in claim 1 containing 1% by weight to 10% by weight of a dehydrating agent.

14. A detergent composition as in claim 1 having a viscosity at 25° C. of 80,000 mPa•s to 250,000 mPa•s, as measured with a Brookfield rotational viscosimeter (spindle No. 7) at 5 r.p.m., and a viscosity of 20,000 mPa-s to 80,000 mPa•s at 50 r.p.m. under the same conditions.

15. A detergent composition as in claim 1 wherein said alkalizing agent comprises alkali metal silicate.

* * * * *